US005553444A

United States Patent [19]

Lovecky et al.

[11] Patent Number: 5,553,444

[45] Date of Patent: Sep. 10, 1996

[54] STORAGE CONTAINER FOR A MEMORY DEVICE AND METHOD OF MAKING

[75] Inventors: Craig Lovecky, Old Orchard Beach; Richard Rolfe, Biddeford, both of Me.; Alan B. Lowry, Canton, Mass.; Robert Steller, Old Orchard Beach, Me.

[73] Assignee: Shape Inc., Biddeford, Me.

[21] Appl. No.: 306,466

[22] Filed: Sep. 15, 1994

[51] Int. Cl.[6] ..... B65B 23/00; B65D 81/16

[52] U.S. Cl. ..... 53/453; 53/472; 53/561; 206/591; 206/724

[58] Field of Search ..... 53/472, 453, 467, 53/484, 561, 559; 206/307, 313, 594, 592, 591, 387.13, 472, 474, 475, 334, 332, 724, 723, 722, 701

[56] References Cited

U.S. PATENT DOCUMENTS

| | | | |
|---|---|---|---|
| 1,821,692 | 9/1931 | Copeland | 206/386 |
| 3,232,421 | 2/1966 | Young . | |
| 3,243,037 | 3/1966 | Luertzing . | |
| 3,261,456 | 7/1966 | Sparks . | |
| 3,604,556 | 9/1971 | Schwartz | 206/387 |
| 3,999,661 | 12/1976 | Jones | 206/591 |
| 4,043,451 | 8/1977 | Johnson | 206/591 X |
| 4,105,121 | 8/1978 | Mascetti | 206/592 |
| 4,114,761 | 9/1978 | Kleiner | 206/591 |
| 4,160,503 | 7/1979 | Ohlbach | 206/328 |
| 4,522,303 | 6/1985 | Starr | 206/588 |
| 4,615,464 | 10/1986 | Byrns | 220/469 |
| 4,681,227 | 6/1987 | Tamura et al. | 206/455 |
| 4,729,478 | 3/1988 | Thomas | 206/591 |
| 4,733,776 | 3/1988 | Ward | 206/305 |
| 4,768,648 | 9/1988 | Glass | 206/38 |
| 4,796,755 | 1/1989 | Ardenti | 206/444 |
| 4,824,059 | 4/1989 | Butler | 248/176 |
| 4,915,222 | 4/1990 | Reidinger et al. | 206/328 |
| 4,938,360 | 7/1990 | Wallace | 206/591 X |
| 5,002,184 | 3/1991 | Lloyd | 206/305 |
| 5,002,188 | 3/1991 | Dickie | 206/589 |
| 5,088,601 | 2/1992 | Seefeldt | 206/334 |
| 5,145,068 | 9/1992 | Schmitz et al. | 206/472 |
| 5,160,001 | 11/1992 | Marceau | 190/102 |
| 5,217,119 | 6/1993 | Hollingsworth | 206/583 |
| 5,234,351 | 8/1993 | Dixon | 439/160 |
| 5,267,647 | 12/1993 | Stumpff et al. | 206/310 |

(List continued on next page.)

FOREIGN PATENT DOCUMENTS

| | | | |
|---|---|---|---|
| 509664 | 10/1992 | European Pat. Off. . | |
| 3501478 | 7/1986 | Germany | 206/521 |
| 1368359 | 9/1974 | United Kingdom . | |
| 2199015 | 6/1988 | United Kingdom . | |

OTHER PUBLICATIONS

British Search Report for corresponding U.K. Application No. 9158560.9.

"Elastomeric Alloy TPEs" *Modern Plastics,* Mid–Oct. 1991, pp. 100–101.

*Primary Examiner*—James F. Coan

*Attorney, Agent, or Firm*—Staas & Halsey

[57] ABSTRACT

A container for a PC card including a relatively hard base pivotably connected by a hinge to a cover. A resilient tray is positioned within the base. The cover can be kept in a closed position by a latch. An outer edge of the tray attaches to a peripheral lip on the base to form a bumper and a seal between the base and cover when the container is closed. The edge also prevents shear movement of the cover relative to the base when the container is dropped on a corner. The hinge and latch are inboard of the outer edge of the tray so that they aren't disturbed if the container is dropped. The tray includes a central receptacle that receives the PC card. Between the PC card receptacle and the outer edge of the tray there is formed a bellows-like member which tangents the cover and base and physically isolates the PC card receptacle from the cover and base. The bellows-like member allows the PC card receptacle to move freely of the base and cover, so should the container with a PC card therein be dropped, the PC card can "float" in the container. It is the bellows that absorbs the shock, not the cover, base or PC card receptacle.

44 Claims, 9 Drawing Sheets

U.S. PATENT DOCUMENTS

| | | | |
|---|---|---|---|
| 5,285,559 | 2/1994 | Thompson et al. | 29/841 |
| 5,285,902 | 2/1994 | Tabuenca Garcia | 206/583 |
| 5,310,054 | 5/1994 | Stumpff et al. | 206/310 |
| 5,323,898 | 6/1994 | Kester | 206/332 |
| 5,339,222 | 8/1994 | Simmons et al. | 361/818 |
| 5,341,926 | 8/1994 | Leben | 206/307 |
| 5,344,039 | 9/1994 | Taniyama | 220/520 |
| 5,363,956 | 11/1994 | Taniyama | 206/312 |

STORAGE CONTAINER FOR A MEMORY DEVICE AND METHOD OF MAKING

BACKGROUND

This invention relates to containers and, more particularly, to a container that safely houses a memory device, such as a PCMCIA card.

Various memory devices are known, such as bubble memory, CD ROMS, optical discs, PCMCIA cards, "Winchester" or hard drives of various formats, etc., which are sensitive to shock, dust, moisture, etc.

PCMCIA cards, in particular, also known as PC cards, are relatively new computer memory devices. These cards are currently available in three different versions, Types I, II and III, which types are dictated by certain industry standards.

Many new laptops and notebook computers are equipped to use PC cards. In this regard, each type of PC card shares the same plug-in matrix for connection to the computer. The three types differ otherwise, however, by thickness, due to memory capability. More particularly, the Type I card includes circuitry that has fixed data thereon for retrieval, e.g., a word processing program. The Type II card merely has more of this circuitry yielding greater memory capacity. The Type III card includes a hard drive and magnetic media to allow storage of new information, such as a revised financial report. The Type I and II cards currently have no hard drives.

In particular regard for the Type III card, each of which currently costs several hundred dollars due mostly to the presence of the hard drive, the arm of the drive, along with other moving internal components, is very sensitive to shocks resulting from dropping, banging, etc., and to flexing resulting from handling or movement. Too much shock or flexing can render a Type III card inoperable. In general, the Type III card, as well as the Type I and II cards, should be kept free from extreme temperatures, direct sunlight, humidity or actual moisture accumulation, dust, spills, foreign objects, pencil shavings, etc. All of these external factors can effect a PC card's performance.

Currently, PC cards are shipped from the manufacturer and offered at retail simply in a cardboard box with foam therearound, in a plastic sleeve that is open along one side, or in a container similar to the "jewel box" which is widely used for compact disc sales and storage. Each of these containers is relatively easy to use, but may break or be discarded after purchase which precludes any continued protection for the cards. Further, foam is not preferred since it is bulky and gives off debris that may find its way into the PC card and onto the drive mechanism of a Type III card.

Generally, there appears to be little consideration given by card manufacturers as to what may happen to the PC card during shipment, or how the end user will handle the PC card after purchase. In this regard, as PC cards become more popular, more and more average consumers, rather than relatively sophisticated and careful, full-time computer users, will be handling and sharing these cards.

Also, as these convenient types of computer memory become more popular, people will travel with several cards, perhaps several Type I and one Type III. Airports may have available computers for use of these portable, personal cards. Alternatively, public telephones may be equipped to receive the cards so that data thereon can be transmitted to a remote computer. In either case, these cards are becoming relatively common items that must sustain the usual conditions of travel, work, etc.

The conventional containers discussed above for storing memory devices and particularly PC cards lack the ability to protect the PC card from primarily shock and flexing, and secondarily from other hazards such as moisture. For example, if a conventional container with a PC card therein is dropped, not only will the PC card suffer the full shock and "aftershock" of the fall, but the container may open and allow the PC card to fall. As a result, the chance for damage to memory devices, and particularly the Type III PC card, is a problem in the industry.

It is not believed the computer or container art has addressed this problem. More particularly, the prior art lacks any convenient, easy to use, safe and portable container for memory devices and more particularly PC cards.

SUMMARY OF THE INVENTION

Accordingly, it is a purpose of the present invention to provide a reliable and safe storage device for PC cards that is also low cost for the average consumer.

It is another purpose of the present invention to provide a user-friendly storage container for a PC card.

It is another purpose of the present invention to provide a container which prevents damage to a PC card.

It is another purpose of the present invention to provide a virtually air and water-tight container for a PC card.

It is another purpose of the present invention to provide a container that prevents damage to the hard drive of a PC card from, e.g., dropping, flexing, moisture, etc.

Finally, it is a purpose of the present invention to provide a PC card storage container that can fit in a pocket, is durable, easy to use and transport, and is see-through.

To achieve the foregoing and other purposes of the present invention there is provided a relatively hard base pivotably connected by a hinge to a relatively hard cover. A resilient tray is positioned within the base. The cover can be kept in a closed position by a latch. An outer edge of the tray attaches to a peripheral lip on the base to form a gasket/bumper between the base and cover when the container is closed. The edge also prevents shear movement of the cover relative to the base when the container is dropped on a corner. The hinge and latch are inboard of the outer edge of the tray so that they aren't disturbed if the container is dropped. The tray includes a central, walled, receptacle that receives the PC card. Between the PC card receptacle and the outer edge of the tray there is formed a bellows-like member which tangents the cover and base and physically isolates the PC card receptacle from the cover and base. The bellows-like member allows the PC card receptacle to move freely of the base and cover, so should the container with a PC card therein be dropped, the PC card can "float" in the container. It is the bellows-like member that absorbs the shock, not the cover, base or PC card receptacle.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in an constitute a part of the specification, illustrate embodiments of the invention and, together with the description, serve to explain the principles of the invention.

DESCRIPTION OF THE PREFERRED EMBODIMENTS

Figure 1:
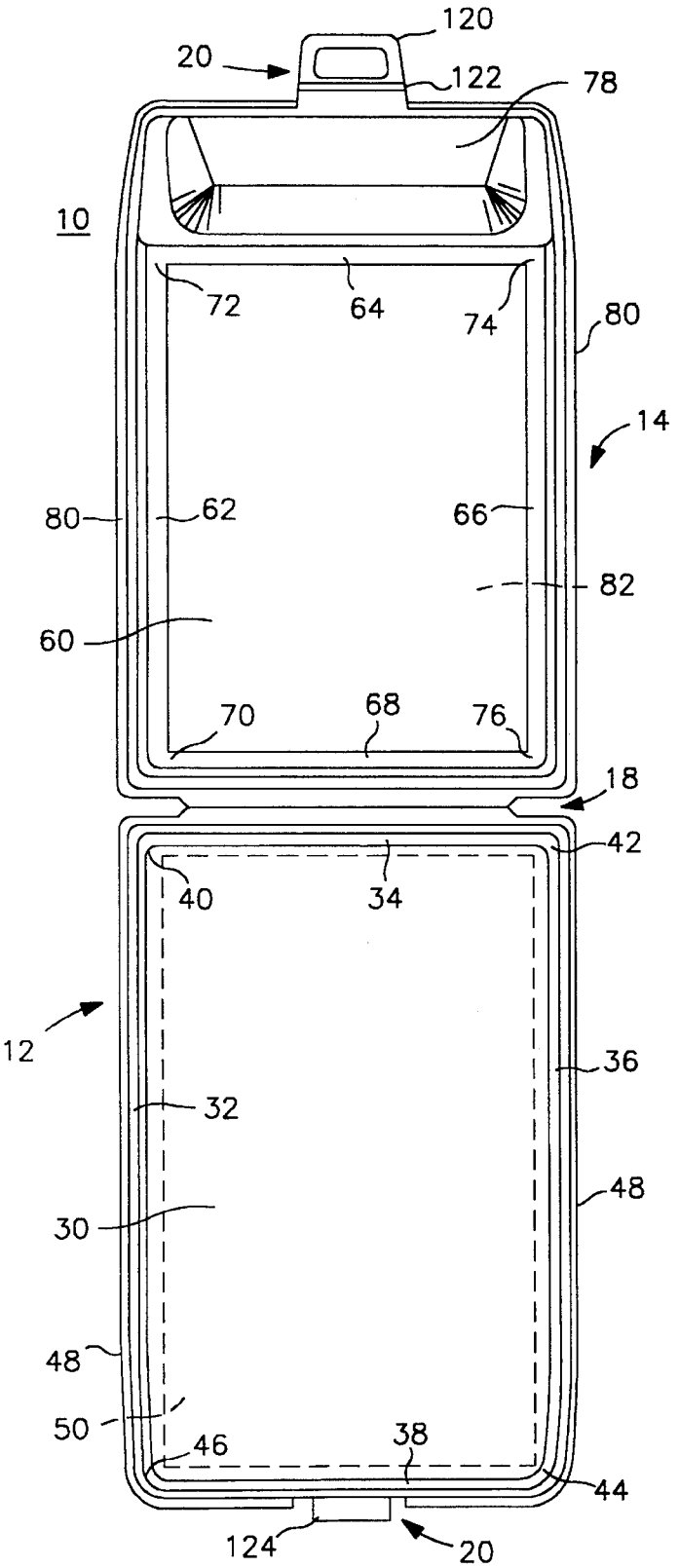
FIG. 1 is a top plan view of the base and cover of the container according to the preferred embodiment of the present invention, illustrating particularly an open configuration.

The preferred embodiments of the storage container according to the present invention will now be described with reference to FIGS. 1–19. In this description, various dimensions are provided but these dimensions are merely for illustrative purposes and are not intended to limit the invention. Further, in the following description and drawings, particular shapes of the container may be suggested. In fact, the invention does not have to be any particular shape in order to satisfy the function of safely storing a PC card.

According to the invention, the storage container is referred to below generally by reference numeral 10. The storage container 10 basically includes a base 12, a cover 14 and a tray 16. The tray, is enclosed within the base 12 and cover 14 as described below. In the preferred embodiment, the base 12 and cover 14 are connected by a hinge 18 to allow convenient and easy opening and closing of the container 10. Further, a latch 20 is employed to keep the container in a closed position when desired. The tray 16 receives a PC card 22 therein.

As best shown in FIGS. 1, 2 and 5–7, the base 12 is a generally rectangular member having a central planar area 30 and four upstanding side walls 32, 34, 36, 38. Each of the side walls 32, 34, 36, 38 is angled obtusely relative to the planar central area 30. In the embodiment shown, the corners 40, 42, 44, 46 where the walls 32, 34, 36, 38 intersect are rounded. The walls 32, 34, 36 and 38 include a perimeter lip 48 that fits into an edge of the tray 16, as described below.

The base 12 can also include a recess 50 formed in an exterior side of the central planar area 30. This recess 50 is intended to receive a label 52 having relevant information or indicia thereon such as the "type" of PC card, the data stored on the card, etc. This labelling ability is important since the requirement for compactness in PC cards does not leave much tolerances for the addition of a label on the card per se. The labelling is easily added to the packaging instead of the PC card.

As also shown in FIGS. 1, 2 and 5–7, the cover is a generally rectangular member having a central planar area 60 and four side walls 62, 64, 66, 68. Each of the side walls 62, 64, 66, 68 is similarly angled obtusely relative to the planar central area 60. Further, the front wall 64 can be a gradual wall having an indentation therein. In the embodiment shown, the corners 70, 72, 74, 76 where the walls 62, 64, 66, 68 intersect are rounded. The walls 62, 64, 66, 68 include a perimeter lip 80 to receive the tray 16 that snaps onto the base 12.

The cover 14, like the base 12, can include a recess 82 formed on an exterior side of the central planar area 60. The recess 82 is intended to receive a label 84 having relevant indicia, like the label 52. In the embodiment discussed below, where the cover 14 is clear, no such label 84 is needed, since the user can see directly to the PC card 22 which may have similar information for identification purposes.

While a cover 14 is described above, a cover 14 is not necessary to benefit from the present invention. That is, a base 12 with a tray 16 therein as described below would serve to substantially protect a PC card from most expected damage. This would be especially true in the case of a shipping container for original equipment manufacturers.

As seen in FIGS. 3, 4, 8, 9 and 13–19 particularly, the tray 16 is generally rectangular in shape corresponding to the shape of the cover 14 and base 12. The tray 16 has a central PC card receptacle 90, a bellows-like or wave-like member 92 and an outer edge 94 that fits between the perimeter lips 48, 80 of the cover 14 and base 12.

Figure 3:
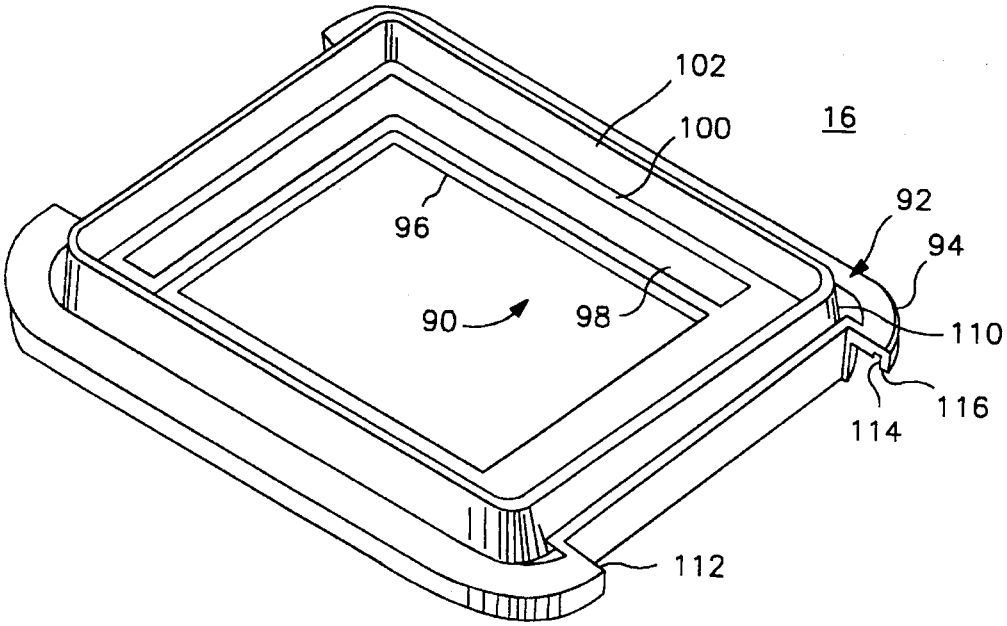
FIG. 3 is a perspective view of a tray of the container according to the present invention.
Figure 4:
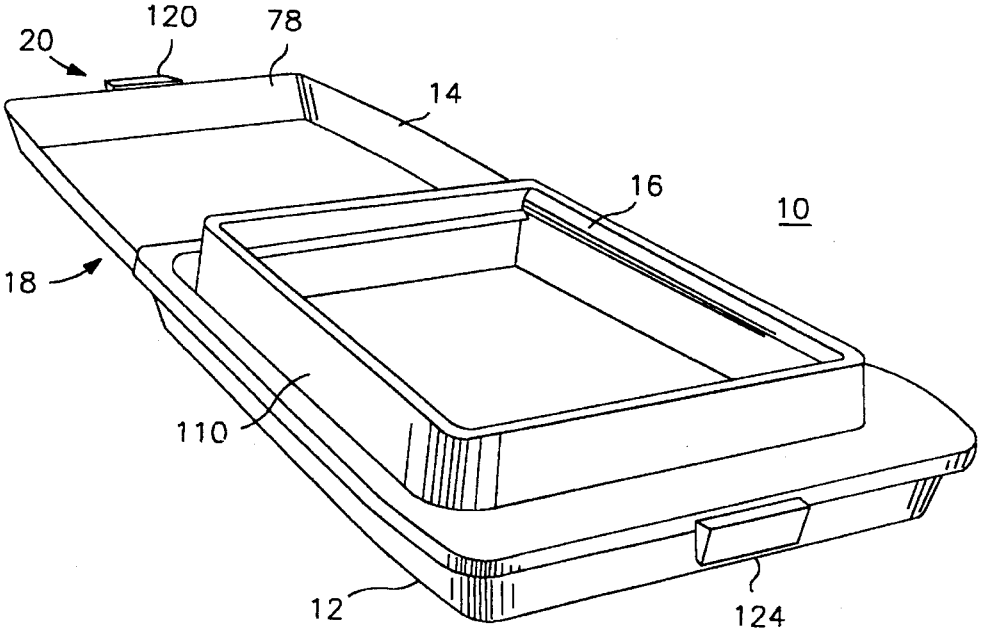
FIG. 4 is a perspective view of the tray positioned in the open container according to the present invention.
Figure 5:
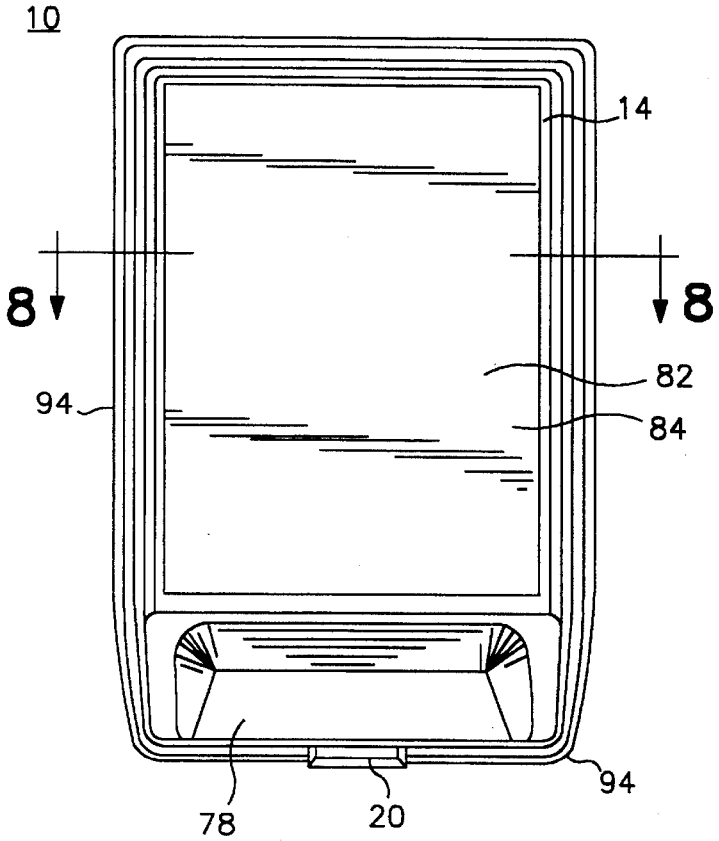
FIG. 5 is a top view of the container in a closed configuration.
Figure 6:
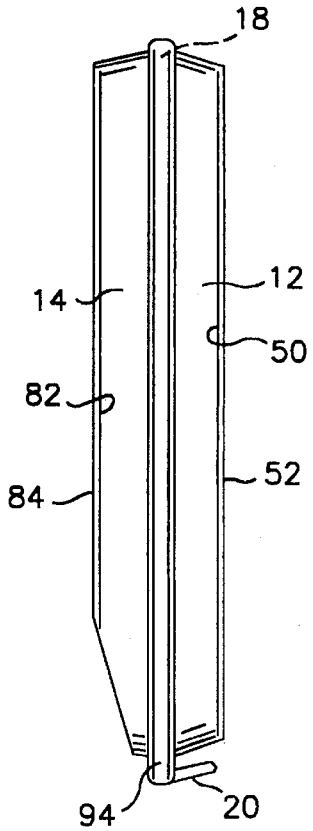
FIG. 6 is a side view of the container shown in FIG. 5.
Figure 7:
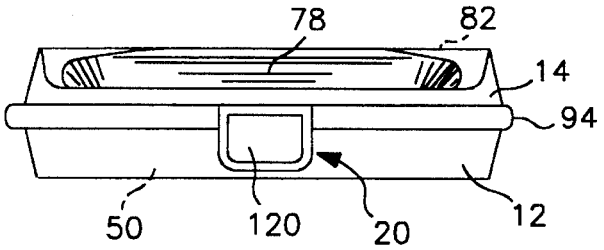
FIG. 7 is a front view of the container shown in FIG. 5.
Figure 8:
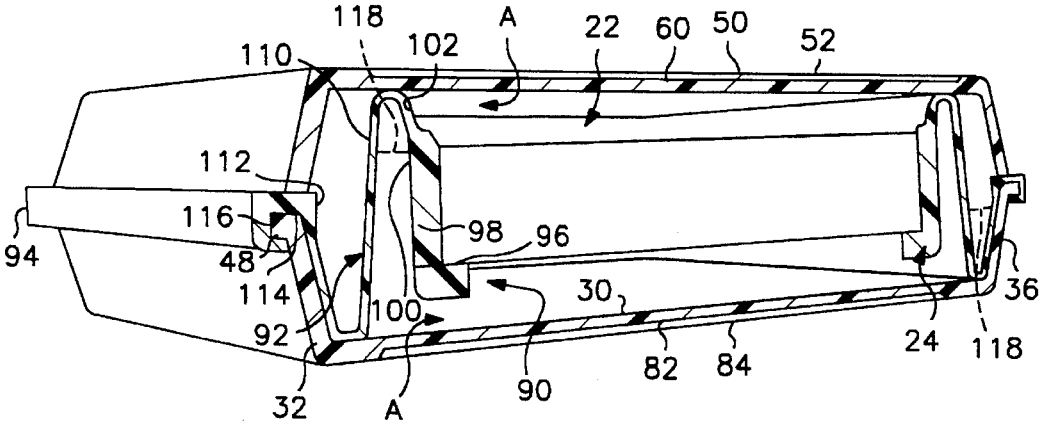
FIG. 8 is a perspective view of the tray inside the container and supporting a PC card, taken along line 8—8 of FIG. 5.
Figure 9:
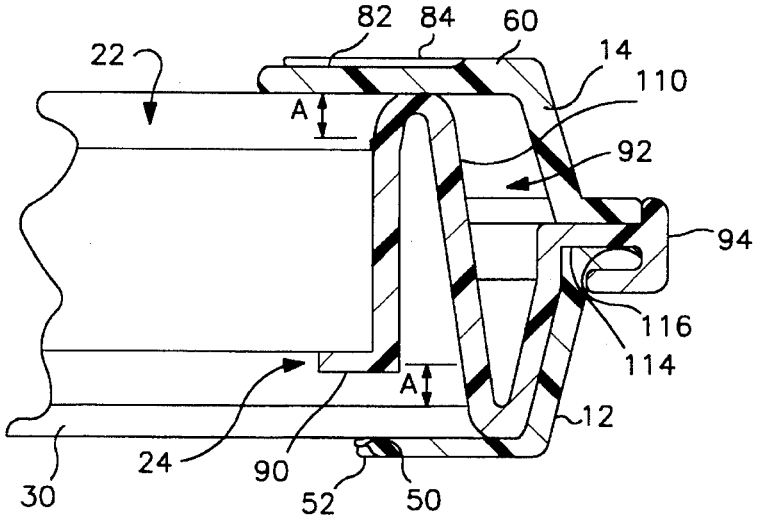
FIG. 9 is an exploded view of one side of FIG. 8, illustrating particularly the floating support of the PC card by the tray.

More particularly, and as shown in FIGS. 3 and 8–9, the PC card receptacle 90 can include a first inner flat ledge 96 that receives the underside of the outer periphery 94 of the PC card 22. Instead of just an inner ledge 92, the bottom of the tray 16 can be continuous, although this would increase material usage, cost and weight. Also, since the PC card 22 is rigid, there is no need for full support thereof by a full bottom of the tray 16.

Just adjacent to this first inner ledge 96 is a first perpendicular wall 98 that receives the vertical edge of the outer periphery 24 of the PC card 22. The length and width of the first perpendicular wall 98 are about the same as the corresponding dimensions of the PC card 22 so that the PC card is snugly received thereon.

Next outwardly adjacent in this embodiment is a second ledge 100 that is parallel to the first inner ledge 96, and then a second perpendicular wall 102 that is parallel to the first perpendicular wall 98.

Next outwardly is the bellows- or wave-like member 92, a substantial portion 110 of which is angled acutely relative to the second perpendicular wall 102 and an end 112 of which terminates in the outer edge 94 which is positioned about halfway along the portion 110 of the member 92.

The outer edge 94 is not continuous in the preferred embodiment: it is interrupted at the hinge 18 of the container and at the latch, 20, both of which are discussed in greater detail below. Within the outer edge 94, on an underside 114 thereof, is a recess 116 which corresponds to the shape of the perimeter lip 48 formed on the base. Alternatively, the bellows-like member 92 can be inverted. That is, the member 92 can extend upwardly from the outer edge 94 and connect to the PC card receptacle 90 at the lower end of the receptacle 90. The former structure, however, is preferred, since it allows the portion 110 of the member 92 to locate along the wall 34 of the base 12. Additionally, the bellows-like member 92 can be reinforced by webs 118 (FIG. 8) extending between the upper and lower sections of the "S" or wave and the receptacle 90 and outer edge 94, respectively. These webs 118 would help prevent any bottoming out of the receptacle 90 on the base 12 or cover 14.

It is to be noted that there is a clearance "A" between the bottom and top of the PC card receptacle and the base 12 and cover 14, respectively. This is always true even if the container 10 is dropped. In this way, any shock is taken up by the bellows-like member 92 and the PC card receptacle 90 does not receive shock through the cover 14 and/or base 12.

With the above-described configuration, all four sides of the PC card receptacle 90 are compliant and the tray 16 allows controlled up and down movement of the PC card 22. These factors allow the container 10 to be subjected to shock or flexure, without transferring same to the "floating" PC card.

The preferred embodiment of the tray 138 is shown in FIGS. 13–19. More particularly, the PC card receptacle 140 includes first inner ledges 142 on three sides that receive the underside of the outer periphery 24 of the PC card 22. Two opposing inner ledges 142 include extensions 144 resting on the planar area 30 of the base 12.

Just adjacent to the first inner ledges 142 is a first perpendicular wall 146 that receives the vertical edge of the outer periphery 24 of the PC card 22. The length and width of the first perpendicular wall 146 are about the same as the corresponding dimensions of the PC card 22 so that the PC card is snugly received thereon.

Next outwardly is the bellows- or wave-like member 148, a substantial portion 150 of which is angled acutely relative to the first perpendicular wall 146, and an end 152 of which terminates in the outer edge 154 which is positioned about halfway along the portion 150 of the member 148.

The outer edge 154 is again not continuous in the preferred embodiment: it is interrupted at the hinge 18 of the container and at the latch, 20. Within the outer edge 154, on an underside 156 thereof, is a recess 158 which corresponds to the shape of the perimeter lip 48 formed on the base 12.

The bellows-like member 148 is reinforced by vertical ribs 160 extending between the upper and lower sections of the "S" or wave of the bellows-like member 148 and the outer edge 154 and wall 146 to help prevent too much floating which might pass forces from any aftershock to the PC card.

It is to be noted that there is still a clearance "A" between the bottom and top of the PC card receptacle and the base 12 and cover 14, respectively. In this way, shock is still taken up by the bellows-like member 148 and the ribs 160, and the PC card receptacle 140 does not receive shock through the cover 14 and/or base 12.

Further, to prevent the PC card from moving within the PC card receptacle 140 an upper ledge 162 is formed at the front of the container, on the end of the PC card receptacle 140 lacking a first inner ledge 142. Also, a flexible tab 164 is formed on the opposite end of the tray 138, at the top of the tray. By using the flexible flap 164 integral to the tray 138 a separate member and separate molding and inserting step are avoided. Further, the flap 164 is conveniently moved into and out of position by merely closing and opening the container, respectively.

Figure 15:
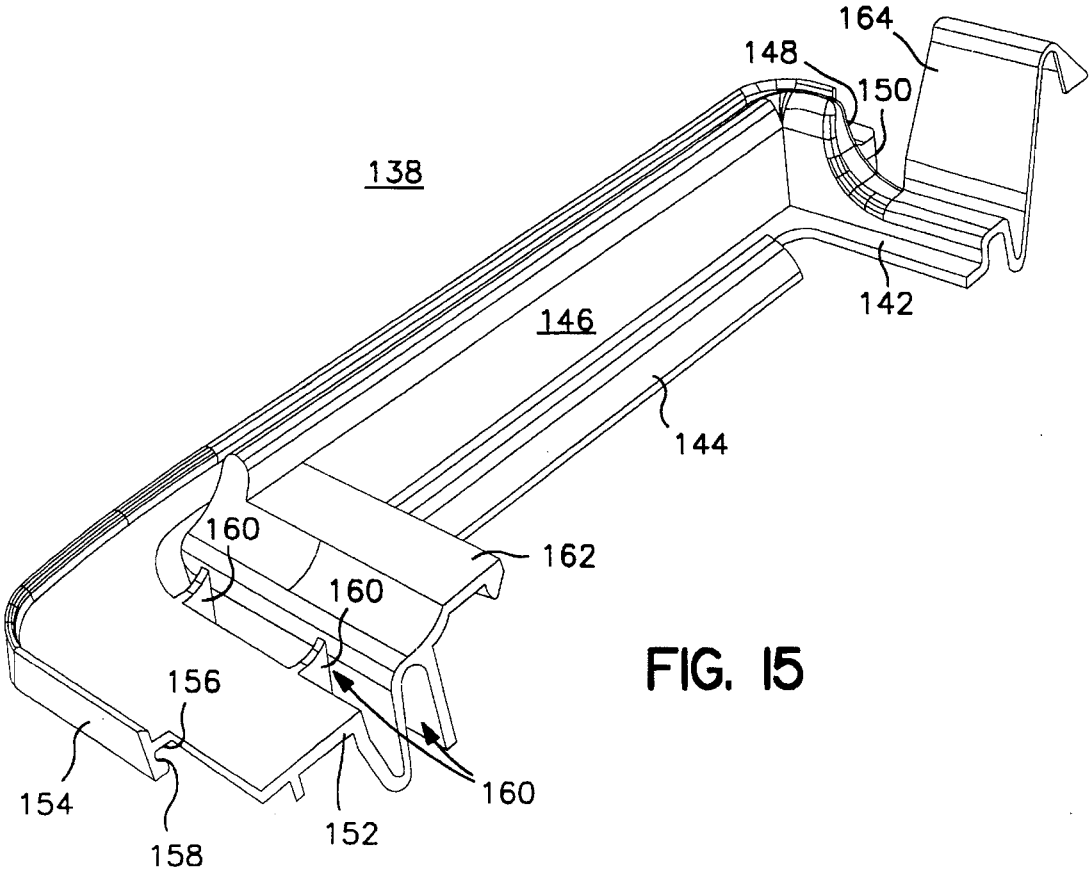
FIG. 15 is a perspective view of the cross-section shown in FIG. 14.

FIG. 15 illustrates the use of ribs 160 between the bellows-like member 148 and the wall 146 and outer edge 154. Further, the extensions 144 are illustrated on the opposing lateral inner ledges 142. The relationship between the upper ledge 162 to the inner lower ledges 142 is also shown. The orientation of the flexible tab 164 before the tray 138 is placed in the base 12 and the cover 14 folded over the base 12 is also indicated.

Figure 16:
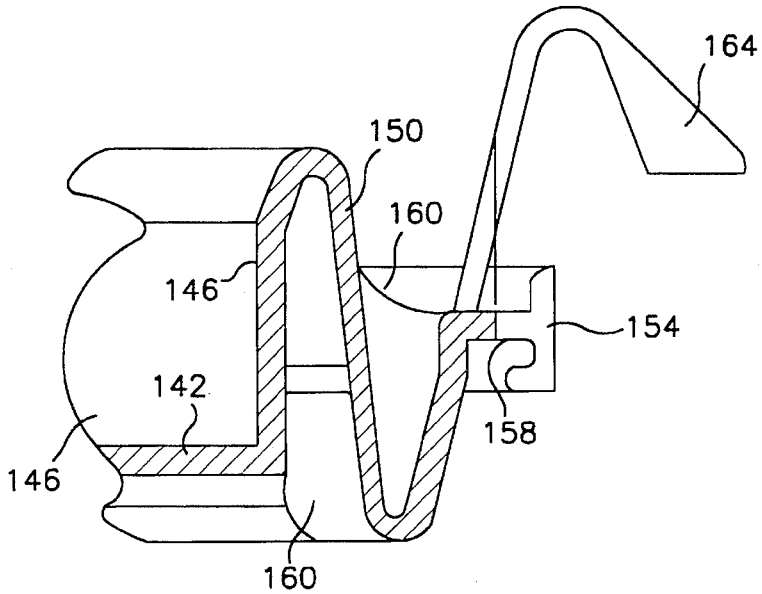
FIG. 16 is an enlarged side cross-sectional view of the rear end of the tray shown in FIG. 14.
Figure 17:
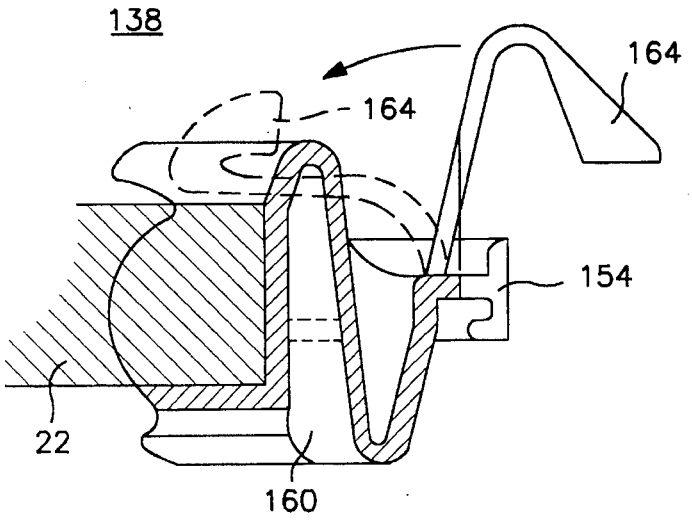
FIG. 17 is a side cross-sectional view of the rear end of the tray shown in FIG. 16 with a PC card therein.

FIGS. 16 and 17 show the front end of the tray 138 without and with the PC card therein, respectively. As shown in FIG. 16, the ribs 160 are shown. The flexible tab 164 extends upwardly in FIG. 16, before the cover is placed on the base. In FIG. 17, when the PC card is inserted in the PC receptacle, and the cover (not shown) is pivoted to cover the base, the flexible tab 164 is pushed by the cover over the PC card, to keep this end of the PC card secure. Thus, the flexible tab 164 provides some flexible spacing between the PC card and the cover and prevents the PC card from moving out of the PC receptacle, against the cover, which would render the PC card susceptible to shock and aftershock caused by dropping the container.

Figure 18:
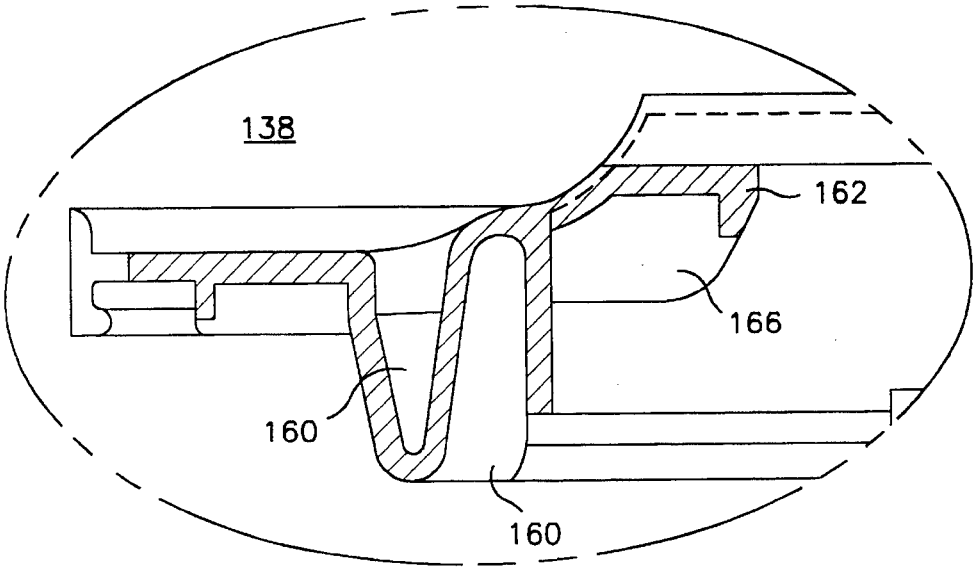
FIG. 18 is an enlarged side cross-sectional view of the front of the tray shown in FIG. 14.
Figure 19:
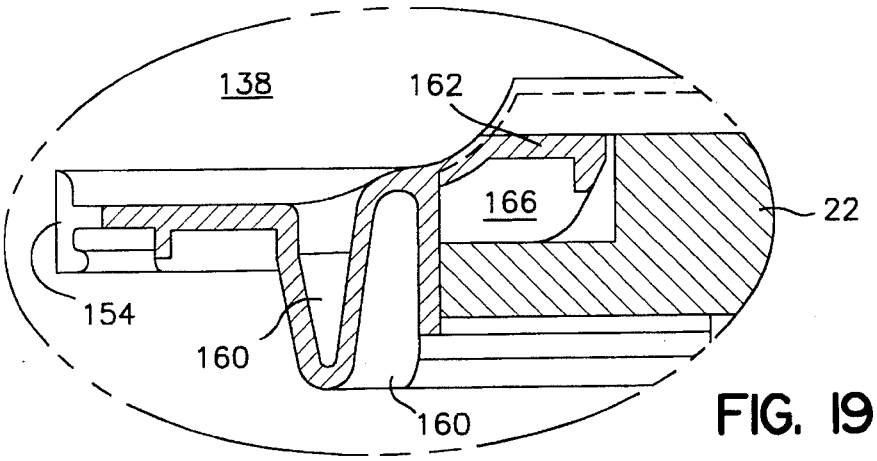
FIG. 19 is a side cross-sectional view of the front end of the tray shown in FIG. 18 with a PC card therein.

FIGS. 18 and 19 show the rear end of the tray without and with the PC card therein, respectively. As shown in FIG. 18, the upper ledge 162 includes vertical ribs 166 on an underside thereof. These ribs 166 serve to resiliently hold one end of a Type III PC card in the PC card receptacle 140, as shown in FIG. 19.

With the above-described configuration, all six sides of the PC card receptacle 140 are compliant and the tray 138 allows controlled up and down movement of the PC card 22. These factors allow the container 10 to be subjected to shock or flexure, without transferring same to the "floating" PC card.

During manufacture of the storage container 10 according to the present invention, the tray 16, 138 is snapped into the base 12 such that the outer edge 94, 154 thereof surrounds the perimeter lip 48 of the base 12. Alternatively, the outer edge 94, 154 does not have to include the recess 116, 158. Instead, the outer edge can be attached to the perimeter lip 48 of the base 12 using, e.g., an adhesive.

With the cover 14 closed, the perimeter lip 80 of the cover 14 abuts the outer edge 94, 154 of the tray 16, 138 and creates effectively a gasket between the cover 14 and base 12. The fact that the cover perimeter lip 80 rests in the resilient outer edge 94, 154 of the tray 16, 138 limits the movement of the cover 16 which prevents shear when the container 10 is hit on a corner. In this way, a substantial portion of the outer edge 94, 154 of the tray 16, 138, can extend beyond the outer dimensions of the sides of the cover 14 and base 12. This causes a type of "bumper" to be formed around the storage container 10. This orientation is shown, e.g., in FIGS. 4–9.

When the tray 16, 138 is installed in the base 12, the lower curve of the wave or "S" abuts the planar area 30 of the base 12 adjacent the side walls. When the cover 16, 138, is closed relative to the base 12, the upper curve of the wave or "S"

abuts the planar area 60 of the cover 14 adjacent to the side walls. The PC card receptacle 90, 140 does not abut the cover 14 or base 12, but merely supports the PC card 22.

The bellows-like member 92,148 tangents the cover 14 and base 12 and isolates the PC card receptacle 90, 140 from the cover 14 and base 12. The member 92,148, allows the PC card receptacle 90, 140 to move freely of the base 12 and cover 14, so should the container 10 with a PC card 22 therein be dropped, the PC card 22 "floats" in the container. It is the bellows-like member 92, 148 that absorbs the shock, not the cover 14, base 12 or PC card receptacle 90, 140.

Of course, the bellows-like member 92,148 does not have to be configured just as shown. The important consideration is that there be a member between the cover 14 and base 12 that supports the PC card 22 resiliently and from the cover 14 and base 12. Other, equivalent resilient members can be used.

The overall length of the closed container 10 is about 4.815 inches, including the exposed outer edge 94, 154, of the tray 16. The overall width of the closed container 10 is about 3.315 inches, again including the exposed outer edge 94, 154, of the tray 16. The height of the closed container 10 is about 0.825 inches.

Figure 2:
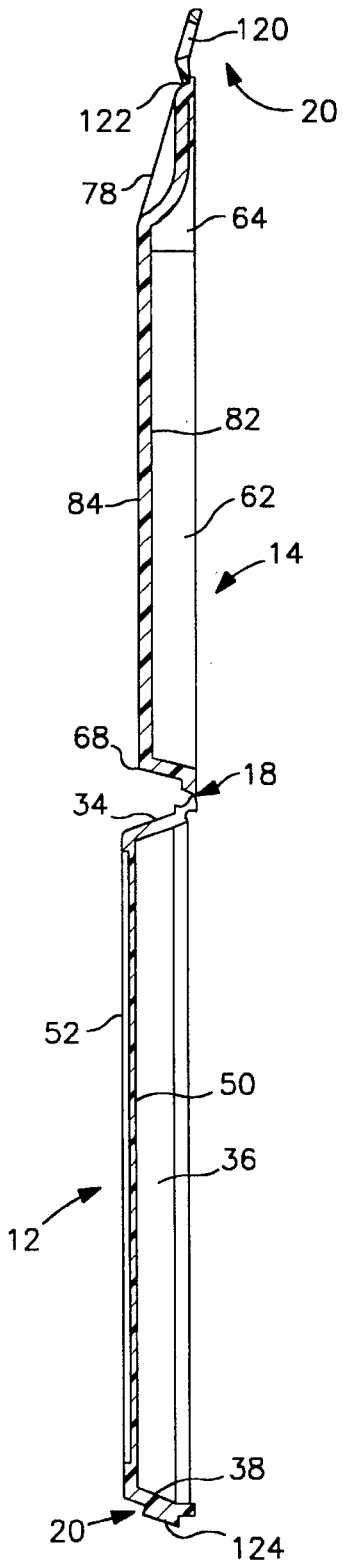
FIG. 2 is a side view of the base and cover shown in FIG. 1.

Preferably the hinge 18 is a living hinge formed between the cover 14 and base 12 as best shown in FIGS. 1–2. Of course, other types of connection of the cover 14 and base 12 can be used as long as they allow adequate movement of the base 12 and cover 14 for removal of the PC card 22. For example, a pin and receptacle pivot at the rear or side corners of the cover and base would be acceptable.

The latch 20 is preferably a strap snap 120 that is formed, e.g. on the cover 14 via another living hinge 122 to mate with a corresponding stationary connection 124 on the base. The strap snap 120 is rotatable into and out of locking engagement with the connection 124 on the base 12. Of course, other types of temporary locks can be used to close the container 10. For example, a sliding lock can be used, as could an interference fit of stationary areas on the cover and base, respectively. Also, the latch 20 can be formed as one piece with the cover 14 and base 12, or separately therefrom and added thereto.

The cover 14, base 12, hinge 18 and latch 20 are preferably molded as one piece, but any of these pieces could be formed separately. The base 12, cover 14, hinge 18 and latch 20 are preferably molded of polypropylene, which exhibits high impact properties and integrity for the living hinges 18, 122 described above. Alternatively, the base 12 and/or cover 14 can be molded of polycarbonate. The average wall thickness of the cover 14 and base 12 is about 0.050 inch.

The tray 16 is preferably injection molded of a high grade thermoplastic elastomer ("TPE") which can be molded in different durometers. Examples are Santoprene™ or Lomad™ rubber, with a specific hardness for the shock required, such as a 64 durometer. Appropriate TPE's are available from companies such as DuPont, Dow, General Electric and Advanced Elastomers. Other materials for the tray 16 may include pliable latex, polyurethane, or rubber coated foam.

Figure 10:
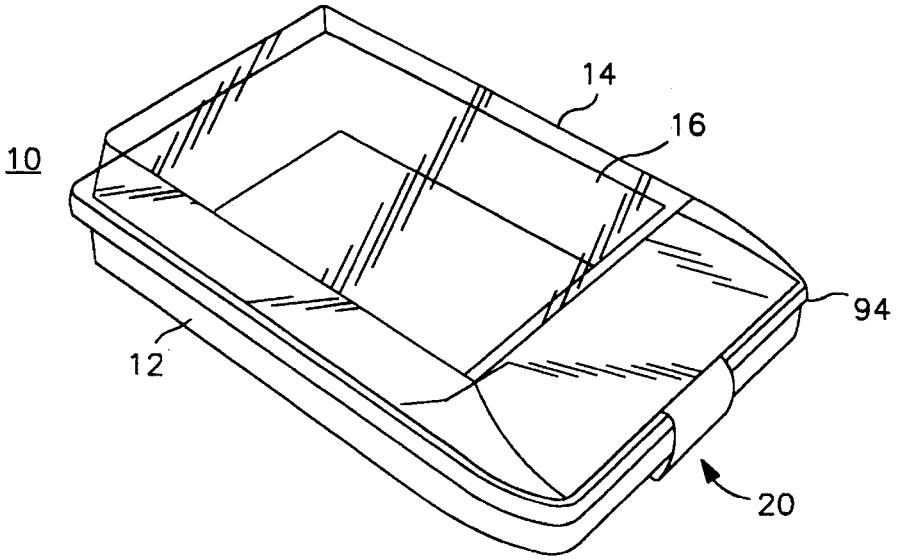
FIG. 10 is a perspective view of an embodiment of the present invention wherein the cover and base are each clear.

The base 12, cover 14 and/or tray 16, 138, can be molded in different colors or clear. For example, the cover 14 can be molded clear to allow the user to quickly see if a PC card 22 is in the container 10, with the base 12 being clear, and tray 16, 138, being a dark color, as shown in FIG. 10. Since the tray 16, 138, includes an opening within the first inner ledge 96, 142, when a clear cover 14 and base 12 are used, the PC card 22 can be seen in the container 10, regardless of whether the cover 14 or base 12 side faces the user. Not only can one see if a PC card 22 is present in the container 10, but one can see any labelling on the PC card 22.

In an alternate embodiment, the base 12, cover 14 and tray 16, 138, are molded as one piece from the same relatively pliable material such as polypropylene or rubber. In this case, the bellows-like member 92, 148 can be integrally connected to the base 12 at various places along the outer edge 94, 154, thereof. For example, the three members could be molded co-planar, with the cover 14 and base 12 connected by the living hinge 18, and the tray 16 (138) connected to the base 12 by a couple of tabs or bridges 126 extending between one side of the tray 16 and an adjacent corresponding side of the base 12. The remaining sides of the tray 16 would also have free tabs or bridges 128 formed thereon. After molding, the tray 16 would be folded over the base 12 on the integral tabs or bridges 126, and the remaining tabs or bridges 128 would rest on the corresponding sides of the base 12. See FIG. 12.

In operation, the storage container 10 is opened by unlocking the latch 20 by moving the strap snap 120 out and rotating it away from the lower, stationary connection 124. The cover 14 is then pivoted on the hinge 18 to open. The PC card 22 is then exposed for easy removal. After use of the PC card 22, the card 22 is placed back into the tray 16, 138, the cover 14 pivoted back to its closed position, and the latch 20 again locked.

In the closed position, the cover 14 locks via the strap snap 120 to assure a positive closure. The perimeter connection of the tray 16, 138 to base 12, and the perimeter lip 80 of the cover 14 resting on the outer edge 94, 154, of the tray 16, 138, forms an effective gasket that is virtually air and water tight, nests the cover 14 when closed for shear and impact integrity, and allows the tray 16, 138, to float internally for shock absorption of the hard drive inside the PC card 22.

The tray 16, 138, protects all six sides of the PC card 22, which is important because it can never be predicted on which side the container 10 will fall or to which side might be exposed to some other possible damage. In particular, since the outer edge 94, 154, of the tray 16, 138, extends beyond the hinge 16 of the cover 14 and base 12 and the latch 20, if the container 10 is dropped, the hinge 18 and latch 20 are not disturbed and the container 10 remains closed.

Figure 11:
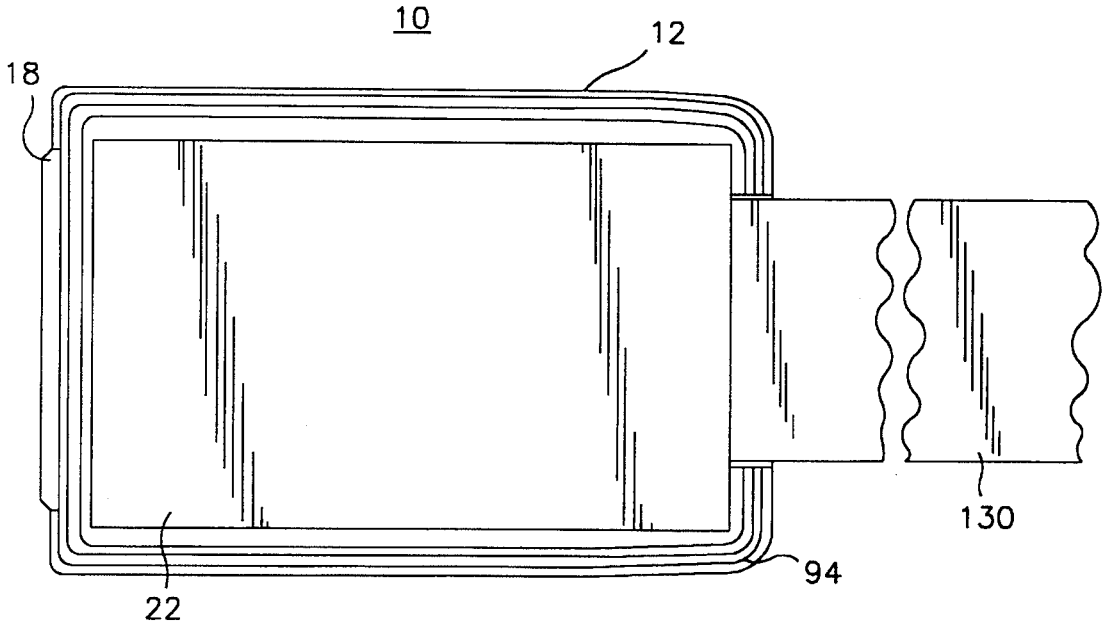
FIG. 11 is a top view of an alternative embodiment of the storage container according to the present invention with the cover removed.
Figure 12:
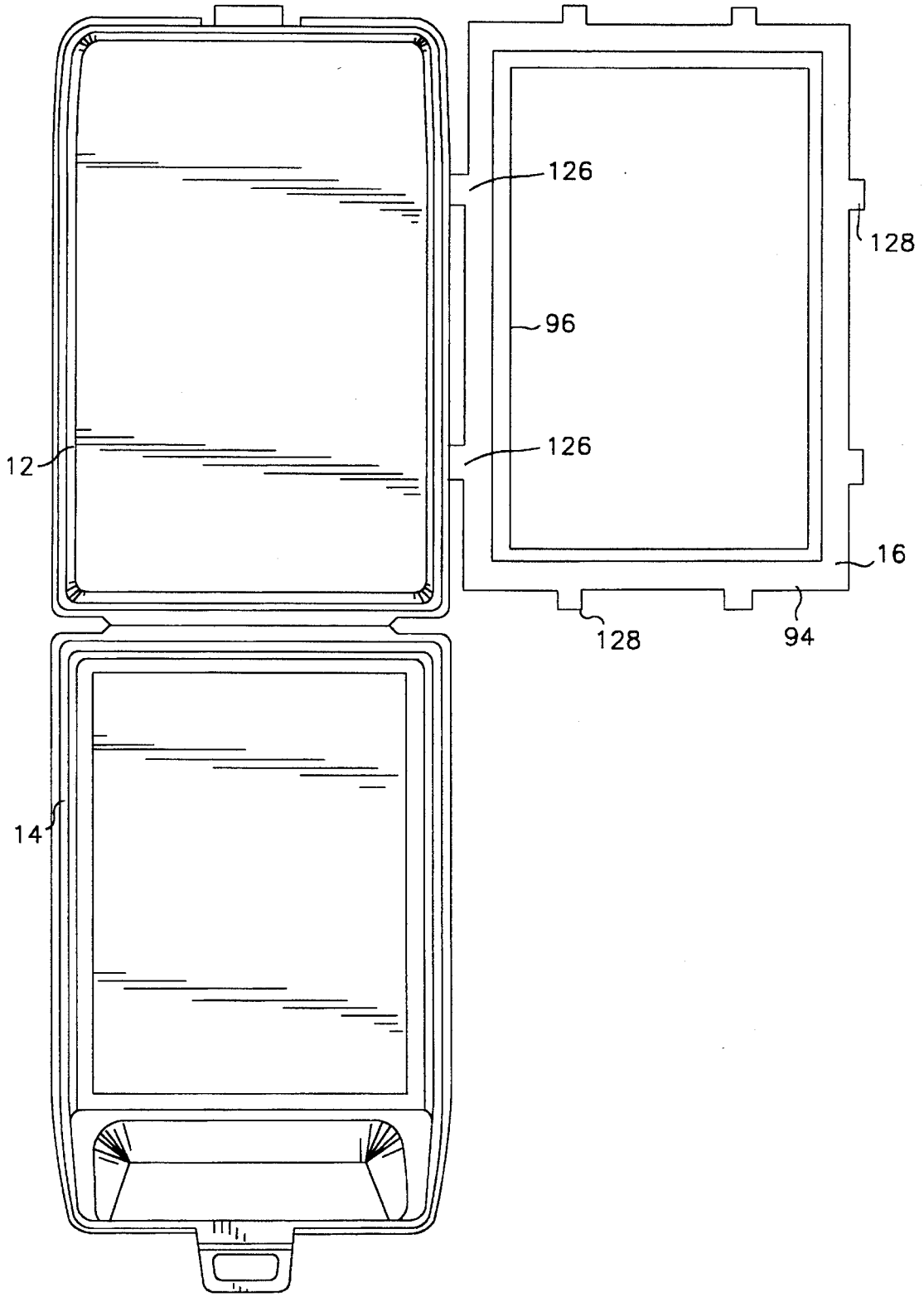
FIG. 12 is a top plan view of an alternate manner of forming the container according to the present invention.
Figure 13:
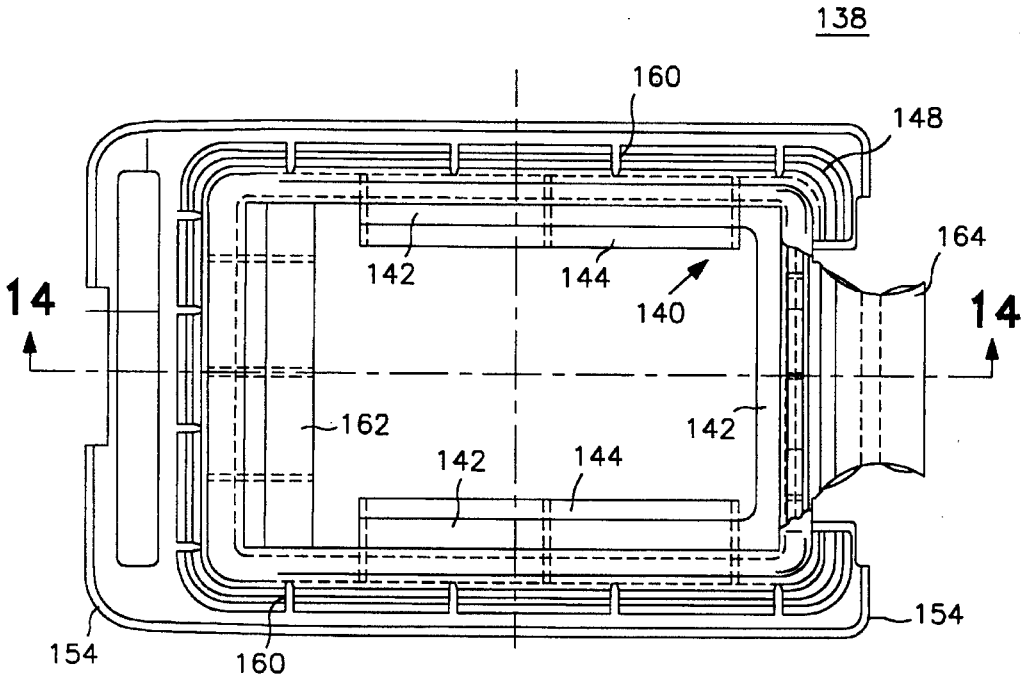
FIG. 13 is a top plan view of one side of the tray according to the present invention.
Figure 14:
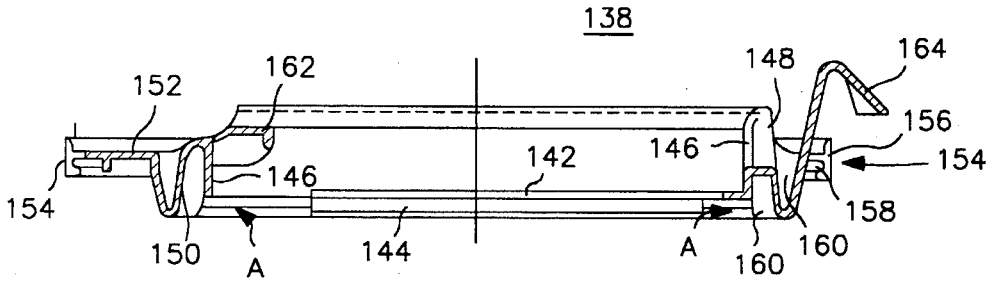
FIG. 14 is a cross-sectional view of the tray shown in FIG. 13 taken along line 14—14.

In an alternate embodiment, shown in FIG. 11, the PC card 22 is effectively permanently enclosed in the container 10. In this figure, the cover 14 has been removed to facilitate viewing of the card 22. This embodiment would appear particularly applicable to a very valuable PC card 22.

In this embodiment, a flexible harness 130 can be connected to the industry standard female connector (not shown) of the PC card 22 with the harness 130 extending out of the container 10. In this regard, the harness 130 contains connectors at both ends thereof, with one male end connecting to the female connector of the PC card 22, and the other end a female end, corresponding to the female end of the PC card 22, for connection to the male connector on a computer. In this embodiment, the latch 20 covers over the female connector of the PC card when the harness 130 is disconnected from the PC card 22. Again, this serves to protect the PC card 22 from damage.

In this alternate embodiment, it is not preferred to have the container 10 air tight. That is some small holes (not shown) should be formed in the container 10 to allow air to get to the hard drive of the PC card 22. The drive generates some heat and it is preferred to allow this heat to dissipate via air holes.

Alternatively, the harness 130 can be manufactured as an integral member with the PC card 22, but still having a free end with a female connector for connection to the male connector of the computer. The harness 130 is received through an opening in an end of the container.

In order to render the container effectively permanently closed for the user, no hinge 18 or latch 20 would be used. Other means could be used to fix the cover 14 relative to the base 12 with the tray 16, PC card 22 and harness 130 therein, such as sonically welding male and female plastic mating members or ribs (not shown) along the perimeter lips 80, 48 of the cover 14 and base 12 that extend through the outer edge 94, 154, of the tray 16, 138. Alternatively, corresponding hooks and openings can be used. In this way, it is not impossible for the container 10 to be opened if necessary, e.g., for servicing by replacing the media in a Type III PC card, but the average user would not be able to gain access to the PC card 22 per se without damaging the container 10.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to that fall within the scope of the invention and the appended claims.

What is claimed is:

1. A container for a sensitive device, comprising:

(a) a base made of a first material and having a perimeter;

(b) a separate member made of a second, more resilient material and including a receptacle for the sensitive device, an outer edge connected to and extending outwardly from the perimeter of the base, and a flexible member formed between the outer edge and the receptacle.

2. The container as recited in claim 1, wherein the second material is a thermoplastic elastomer.

3. The container as recited in claim 1, further comprising:

(c) a cover movably connected to the base between an open position, allowing access to the sensitive device, and a closed position, preventing access to the sensitive device.

4. The container as recited in claim 3, further comprising a hinge connecting the base and cover.

5. The container as recited in claim 4, wherein the hinge is a living hinge molded as one piece with the base and cover.

6. The container as recited in claim 3, further comprising a latch for keeping the cover in the closed position.

7. The container as recited in claim 6, wherein the latch includes a movable member on the cover and a stationary member on the base.

8. The container as recited in claim 3, wherein at least one of the cover and base is clear.

9. The container as recited in claim 3, wherein at least one of the cover and base includes a recess on an exterior surface thereof to receive an insert having indicia thereon.

10. A storage container for a PC card, comprising:

a base made of a first relatively rigid material and having a perimeter;

a cover made of the first material and having a perimeter; and a separate tray which, is made of a second, more resilient material, includes a perimeter which connects to and extends outwardly beyond the perimeters of the base and cover, a receptacle for the PC card, said receptacle being spaced from the base and cover, and a flexible portion between the perimeter of the tray and the receptacle, wherein the flexible portion includes at least a first portion which abuts the base and at least a second portion which abuts the cover.

11. The storage container as recited in claim 10, further comprising:

a hinge connecting the cover and base to allow opening and closing of the storage container; and a latch on the cover and base to keep the container closed when desired.

12. The storage container as recited in claim 10, wherein each of the base and cover is a rectangular member having a central planar area, four side walls, and a perimeter lip terminating at least a portion of each of the side walls.

13. The storage container as recited in claim 12, wherein the tray is rectangular and the flexible member is a bellows-like member having as the perimeter an outer edge that fits between the perimeter lips of the cover and base and includes the first and second portions.

14. The storage container as recited in claim 13, wherein the PC card receptacle includes, in a progressively outward order, an inner flat ledge that receives an underside of an outer periphery of the PC card, and a perpendicular wall that receives an outer peripheral edge of the PC card, a length and width of an area defined by the perpendicular wall being about the same as the corresponding dimensions of the PC card.

15. The storage container as recited in claim 10 further comprising:

at least one ledge on the tray for retaining at least one edge of the PC card in the PC card receptacle.

16. The storage container as recited in claim 10 further comprising a flexible flap, formed on the tray which, when the cover is closed relative to the base, is moved into abutting relationship between the PC card and the cover.

17. The storage container as recited in claim 14, wherein the first portion includes a lower curve abutting the planar area of the base adjacent to the base side walls and the second portion includes an upper curve abutting the planar area of the cover adjacent to the cover side walls, when the cover is closed relative to the base.

18. The storage container as recited in claim 17, wherein the bellows-like member further comprises a substantial portion which is angled acutely relative to the perpendicular wall and an end which terminates at the outer edge.

19. The storage container as recited in claim 13, wherein the bellows-like member tangents the cover and base and spaces the PC card receptacle from the cover and base.

20. The storage container as recited in claim 13, wherein the outer edge is interrupted at the hinge and at the latch.

21. The storage container as recited in claim 13, wherein the outer edge of the tray includes a recess which receives the perimeter lip formed on the base and, wherein, when the cover is closed, the perimeter lip of the cover abuts the outer edge of the tray.

22. The storage container as recited in claim 13, wherein a clearance exists between at least a portion of the bottom and top of the PC card receptacle, and the base and cover, respectively.

23. The storage container as recited in claim 12, wherein at least one of the planar areas of the cover and base includes an exterior recess which receives a label having indicia thereon.

24. The storage container as recited in claim 11, wherein the hinge is a living hinge formed between the cover and base.

25. The storage container as recited in claim 11, wherein the latch is a strap snap that is formed on the cover via a living hinge to mate with a corresponding stationary connection formed on the base, and wherein the strap snap is rotatable into and out of locking engagement with the connection on the base.

26. The container as recited in claim 10, wherein at least one of the cover and base is clear.

27. The container as recited in claim 10, wherein the second material is a thermoplastic elastomer.

28. A method for forming a storage container for a sensitive device, comprising the steps of:

molding a base and a cover from a first material, each having a perimeter, and a separate tray from a second more resilient material, the tray having a receptacle for the sensitive device and a perimeter; and placing the tray in the base such that the perimeter of the tray is connected to and extends beyond the perimeters of the base and cover, and the receptacle is spaced from the cover and base.

29. The method as recited in claim 28, further comprising the steps of:

locating a sensitive device in the receptacle; and closing the cover relative to the base.

30. The method as recited in claim 29, further comprising the step of substantially non-removably connecting the cover to the base to permanently enclose the sensitive device in the container.

31. The method as recited in claim 30, further comprising the step of:

connecting an electrical connection to the sensitive device with the connection extending out of the container.

32. The method as recited in claim 28, further comprising the steps of:

forming a hinge connecting the cover and base to allow opening and closing of the storage container; and forming a latch on the cover and base to keep the container in a closed position when desired.

33. The method as recited in claim 32, further comprising the step of:

molding the base, cover, hinge and latch as one piece from the first material.

34. The method as recited in claim 32, further comprising the step of:

selecting the first material from one of polypropylene and polycarbonate.

35. The method as recited in claim 28, further comprising the step of:

selecting the second material as an thermoplastic elastomer.

36. The method as recited in claim 28, further comprising the step of:

molding the cover of a clear plastic.

37. A method for forming a storage container for a sensitive device, comprising the steps of:

molding a base, a cover, and a resilient tray having a receptacle for the sensitive device and a flexible flap;

placing the tray in the base such that the receptacle is spaced from the cover and base; and closing the cover relative to the base, wherein the cover moves the flexible flap into abutting relationship between the sensitive device and the cover.

38. The method as recited in claim 28, further comprising the steps of:

molding the base, cover and tray;

inserting a sensitive device in the tray; and closing the container.

39. The method as recited in claim 28, further comprising the step of:

forming the tray to include a bellows-like member.

40. A method for forming a storage container for a sensitive device, comprising the steps of:

molding the base, cover, and tray having a receptacle for the sensitive device co-planar, with the cover and base connected by a living hinge, and the tray connected to the base by a plurality of bridges extending between one side of the tray and an adjacent corresponding side of the base, and the remaining sides of the tray including free bridges formed thereon, folding the tray over the base on the integral bridges;

placing the tray in the base such that the receptacle is spaced from the cover and and base; and resting the remaining bridges on the corresponding sides of the base.

41. The method as recited in claim 40, further comprising the step of:

molding the base, cover and tray from polypropylene.

42. A method for forming a storage container for a sensitive device, comprising the steps of:

molding a base, cover, and a resilient tray having a receptacle for the sensitive device and at least one ledge for retaining the sensitive device in the tray; and placing the tray in the base such that the receptacle is spaced from the cover and base.

43. A method for forming a storage container for a sensitive device, comprising the steps of:

molding a base having a perimeter, and a resilient member having a receptacle for the sensitive device, said receptacle being spaced from the base, an outer edge and a flexible member between the outer edge and the receptacle; and forming the member such that the outer edge of the member is received within and extends beyond the perimeter of the base, the receptacle is spaced from the base, and the flexible member contacts the base.

44. A container for a sensitive device, comprising:

(a) a base having a perimeter;

(b) a resilient member including a receptacle for the sensitive device, said receptacle being spaced from the base, an outer edge connected to and extending outwardly from the perimeter of the base, and a flexible member formed between the outer edge and the receptacle and contacting the base.

* * * * *